United States Patent [19]

Duchesne et al.

[11] Patent Number: 5,003,352

[45] Date of Patent: Mar. 26, 1991

[54] LIQUID TONER SUPPLY SYSTEM AND METHOD

[75] Inventors: Mark F. Duchesne, Dayton; George A. Gibson, Vandalia; Curtis B. Miller, Kettering; Dinesh G. Punater; Paul V. Sadwick, both of Dayton, all of Ohio

[73] Assignee: AM International, Inc., Chicago, Ill.

[21] Appl. No.: 425,909

[22] Filed: Oct. 24, 1989

[51] Int. Cl.[5] ..... G03G 15/10

[52] U.S. Cl. ..... 355/256; 101/366

[58] Field of Search ..... 355/256, 246, 245; 222/DIG. 1; 430/117, 118, 119, 137, 115; 354/324; 118/689, 690, 691; 101/147, 148, 366

[56] References Cited

U.S. PATENT DOCUMENTS

| | | | |
|---|---|---|---|
| 3,129,115 | 4/1964 | Clark et al. | 355/256 X |
| 3,698,926 | 10/1972 | Furuichi | 117/17.5 |
| 3,907,423 | 9/1975 | Hoyashi et al. | 355/10 |
| 3,949,703 | 4/1976 | Smith et al. | 355/256 X |
| 4,021,586 | 5/1977 | Matkan | 427/17 |
| 4,052,959 | 10/1977 | Hayashi et al. | 118/644 |
| 4,110,029 | 8/1978 | Goshima et al. | 355/256 |
| 4,177,730 | 12/1979 | Schniber et al. | 101/248 |
| 4,220,699 | 9/1980 | Ishida et al. | 430/126 |
| 4,286,039 | 8/1981 | Landa et al. | 430/119 |
| 4,310,238 | 1/1982 | Mochizuki et al. | 355/14 D |
| 4,325,627 | 4/1982 | Surdler et al. | 355/10 |
| 4,455,562 | 6/1984 | Dolan et al. | 346/154 |
| 4,515,292 | 5/1985 | Koos, Jr. | 222/52 |
| 4,563,086 | 1/1986 | Knapp et al. | 355/14 D |
| 4,601,259 | 7/1986 | Yamashita | 118/658 |
| 4,649,818 | 3/1987 | Switall et al. | 101/147 |
| 4,734,737 | 3/1988 | Koichi | 355/14 D |
| 4,760,423 | 7/1988 | Holtje et al. | 355/3 |
| 4,827,309 | 5/1989 | Kato | 355/256 |
| 4,827,315 | 5/1989 | Wolfberg et al. | 346/160 |
| 4,828,956 | 5/1989 | Creatura et al. | 430/137 |
| 4,829,336 | 5/1989 | Champion et al. | 355/246 |
| 4,860,050 | 8/1989 | Kurotori et al. | 430/115 X |
| 4,860,924 | 8/1989 | Simms et al. | 222/56 |

FOREIGN PATENT DOCUMENTS

| | | | |
|---|---|---|---|
| 0306217 | 3/1989 | European Pat. Off. | 355/256 |
| 0015956 | 1/1984 | Japan | 355/246 |

*Primary Examiner*—A. T. Grimley
*Assistant Examiner*—William J. Royer
*Attorney, Agent, or Firm*—Biebel, French & Nauman

[57] ABSTRACT

An automated system and method are provided to supply a liquid toner dispersion to the printing station of a high speed electrophotographic printing press. A highly concentrated form of the liquid toner dispersion is supplied in a first container. Density measurement of the liquid toner in a process tank controls the feed of concentrate to the process tank. Liquid level switches in the process tank control toner carrier liquid flow to the process tank. Conductivity sensor monitoring of the toner in the process tank controls the flow of liquid charge control agent into the process tank. Flow rate of the liquid toner from the process tank to the printing station of the printing unit is controlled by a sensor, logic circuitry, and motorized adjustable flow valve and flow meter.

22 Claims, 3 Drawing Sheets

MV-U
MV-L
AL
AU
A
A3
A4

102
AIR
103
106
104
108
116
110
112
114
AL
118
120
122
AU
124
132
126
134
128
136
140
142
A1
A3
144
A4

LIQUID TONER SUPPLY SYSTEM AND METHOD

FIELD OF THE INVENTION

The present invention pertains to an automated system and method for supplying liquid toner dispersion of a desired solids concentration to the printing station of a high-speed electrophotographic printing press.

BACKGROUND OF THE INVENTION

Electrophotographic printing is well known and has been widely refined. For example, today, almost every office and indeed some homes have electrophotographic copiers. The industry has grown to the point where it is now a highly competitive multibillion dollar industry. In most instances, these home and office copies are capable of providing only about a few copies per minute.

In electrophotography, images are photoelectrically formed on a photoconductive layer mounted on a conductive base. Liquid or dry developer or toner mixtures may be used to develop the requisite image.

Liquid toner dispersions for use in the process are formed by dispersing dyes or pigments and natural or synthetic resin materials in a highly insulating, low dielectric constant carrier liquid. Charge control agents are added to the liquid toner dispersions to aid in charging the pigment and dye particles to the requisite polarity for proper image formation on the desired substrate.

The photoconductive layer is sensitized by electrical charging whereby electrical charges are uniformly distributed over the surface. The photoconductive layer is then exposed by projecting or alternatively by writing an image over the surface with a laser, L.E.D., or the like. The electrical charges on the photoconductive layer are conducted away from the areas exposed to light with an electrostatic charge remaining in the image area. The charged pigment and/or dye particles from the liquid toner dispersion contact and adhere to the image areas of the plate. The image is then transferred to the desired substrate such as a carrier sheet.

In contrast to office and home copiers, high speed electrophotographic printing presses are being developed wherein successive images are rapidly formed on the photoconductive medium for rapid transfer to carrier sheets or the like traveling at speeds of greater than 100 ft./min. and even at speeds of from 300–500 ft./min. As can be readily understood, such high speed machines rapidly consume the solid pigment and/or dye and associated resin particles from the liquid toner baths in order to develop the multitude of latent electrostatic images needed for successful operation of the printing press. Unlike the situation in office and home copies in which an operator can simply replenish consumed liquid toner dispersion by shutting the copier off, opening its housing and replacing the spent liquid toner dispersion with a container of fresh toner dispersion, it is clearly unacceptable to shut down a high speed printing process to make such replacement in light of the rapid consumption of the liquid toner material and hence the frequent replacement thereof. An automated liquid toner supply system is accordingly desirable.

PRIOR ART

A variety of toner parameter monitoring and replenishment systems are known.

For example in U.S. Pat. No. 4,860,924, an electrostatic office copier is disclosed wherein sludging of the working liquid toner suspension is inhibited. A charge director concentrate is supplied to the working developer suspension in response to a conductivity measurement of the working suspension. Additionally, toner concentrate is added to the working suspension in response to an optical transmissivity measurement. Means responsive to the temperature measurement of the working toner suspension are also provided to disable the electrophotocopier if the temperature becomes excessive.

In aforementioned U.S. Pat. No. 4,860,924, the "concentrate" material has a very low viscosity of a few hundred cps measured at zero shear in contrast to the highly viscous sludge-like concentrate used in the present invention. Further, the system is not a high speed system but rather is of the office copier variety. There is further no suggestion in the application directed toward controlling the amount of working suspension that is fed to the printing station in correlation to the speed of the printing press.

In U.S. Pat. No. 4,310,238 (Mochizuki et al), electrical resistivity and optical transmission of a liquid toner dispersion are monitored with additional toner being added to the toner reservoir to maintain the transmissivity of the liquid toner at a value which is a predetermined function of its resistivity. The resistivity sensor comprises a pair of electrodes and the optical transmission detector comprises a light source and a photoreceptor.

For dry toner applications, U.S. Pat. No. 4,734,737 (Koichi) discloses a toner concentration control device which includes a detector and an associated variable flow replenishment means to replenish the dry toner concentration as a result of the detector measurement. Concentration may be measured by either an inductance sensing means or by a L.E.D. and light receiving element. The impedance of a dry toner mixture is measured in Furuichi 3,698,926 with additional toner being added to the toner reservoir in response thereto. U.S. Pat. No. 4,515,292 (Koos, Jr.) discloses an improved inductance measuring system to determine toner concentration in a dry toner developer mixture. Other dry toner concentration measurement devices and responsive replenishment systems are disclosed in U.S. Pat. Nos. 4,563,086 (Knapp et al) and 4,601,259 (Yamashita).

Of further possible interest to the present invention is U.S. Pat. No. 4,828,956 (Creatura) disclosing dry toner processes for maintaining the triboelectric stability of a developer composition and U.S. Pat. No. 4,829,336 (Champion) disclosing a patch sensing toner concentration control method.

Although directed toward the use of dry toner compositions, U.S. Pat. No. 4,827,315 is illustrative of an electrostatic printing press wherein lasers or the like are used to form images on the photoconductive drum and wherein a plurality of print stations may be provided to impart different colors to the web travelling through the press.

Despite the above noted prior art efforts, in light of the rapid consumption of solids particles of the liquid toner dispersions in high speed electrophotographic printing operations, an automated system that is capable of maintaining an adequate reservoir of the proper toner dispersion concentration is needed.

Additionally, there is an even more specific need for an automated supply system that uses a highly concentrated liquid toner dispersion supply to form the desired working solution in the automated system to that the user may simply buy and insert a small container of the concentrate into the system, without the need to buy, transport and insert larger drums of the more diluted working solution dispersion into the system.

SUMMARY OF THE INVENTION

In accordance with the invention, a first tank is provided to hold high concentrate toner material having a solids concentration of about 15–30% non-volatile material. Preferably the non-volatile content is about 22%. This highly viscous sludge consistency concentrate is pumped to a process tank which is adapted to hold a liquid toner dispersion of the predetermined optimal solids concentration level (i.e., the "working solution") that is subsequently used to develop the latent image formed on the photoconductive member. Presently, it is thought that the optimal solids content of the working solution used for image development will be about 2–4% based upon the total weight of the working solution.

Carrier liquid for the working solution is pumped to the process tank. Liquid level sensing devices, such as photoelectric eyes and/or flow valves, control actuation of the pump to provide the carrier liquid to the process tank. When a predetermined, low range liquid level is indicated in the process tank, the carrier liquid pump is actuated to pump carrier liquid into the process tank.

A portion of the liquid toner dispersion contained within the process tank is recycled away from and then back to the process tank where it meets with the sludge-like concentrate material in a static mixer or the like so as to provide agitation and intimate mixing of the concentrate material so that a liquid toner dispersion having the requisite degree of solids content (the "working solution") will be provided and continuously mixed in the process tank.

An optical density sensor is provided in the process tank to sense the concentration of the working solution therein. When the concentration is less than a lower predetermined limit, the pump drive for pumping the concentrate to the process tank is actuated. Similarly, a conductivity sensor is provided in the process tank and, when the conductivity of the working solution in the process tank falls below a given conductivity limit, an electric pump is actuated to pump fresh charge control agent liquid into the process tank.

A maximum level limit switch is also provided in the process tank. When this maximum level limit switch is actuated, the feed of all components to the process tank is halted. This is an especially important feature of the invention that is not common in the office copier art.

An encoder or similar sensing device senses the speed of the rotating electrostatic printing drum on which the latent electrostatic image is formed in accordance with well known procedures. The encoder is electrically connected through a microprocessor or the like to a variable speed, motorized flow valve to vary the rate of working solution flowing from the process tank to the printing station located adjacent the electrostatic printing drum.

A cleaning station is also provided adjacent the electrostatic drum and is supplied with the working solution flowing from the process tank. A return line returns used liquid toner material from the cleaning station to the process tank.

The concentrate flow pump is actuated via the control of a density sensor which, in turn, operates through a microprocessor to control actuation of a two envelope normally closed position solenoid valve to supply air to drive the concentrate pump. Similarly, the conductivity sensor is connected through a microprocessor unit to control the "ON" time of the electric pump needed to pump liquid charge control agent into the process tank.

The lower liquid range level limit switch in the process tank is connected to a microprocessor that in turn controls actuation of a two-envelope, normally closed, solenoid actuated valve that provides pneumatic air to drive the pump associated with the carrier liquid supply flow to the process tank. The encoder that translates the speed of the print cylinder is also suitably connected to a microprocessor that in turn controls the motorized control valve to vary the amount of working solution flowing from the process tank to the printing station of the unit.

Accordingly, a sufficient amount of the highly viscous, sludge-like concentrated liquid toner material and a sufficient amount of the carrier liquid material are automatically caused, by the careful monitoring of the indicated process tank conditions, to flow into the process tank in order to form the working solution. A static mixer or the like disposed within the process tank mixes the high viscosity concentrate and recycled material from the process tank so as to provide a homogeneous working solution mixture of the requisite solids content. The type of mixer used is not critical to the invention.

The invention will now be further described in conjunction with the following detailed description and appended drawings.

In the drawings:

DETAILED DESCRIPTION OF THE PREFERRED EMBODIMENT

Figure 1:
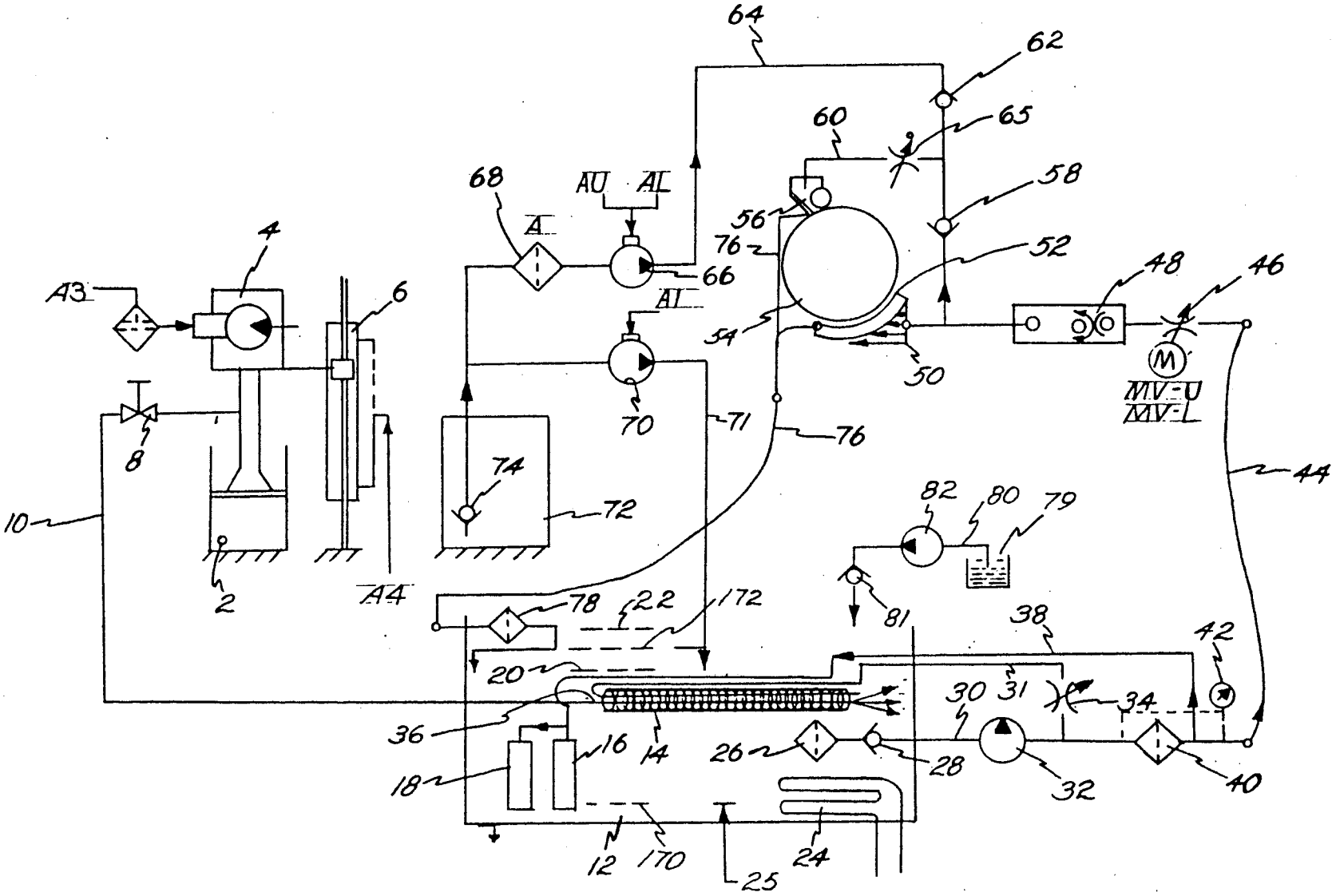
FIG. 1 is a schematic diagram of the toner supply system.

Turning first to the drawings and to FIG. 1 thereof, there is shown a schematic of the fluid flow system of the liquid toner supply apparatus and methods of the invention. Tank 2 is adapted to hold a concentrated supply of liquid toner mixture. By concentrated, it is meant that the degree of solids of the concentrate mixture is greater than the solids content of the toner mixture or dispersion that will ultimately be fed to the print station for utilization in formation of the electrostatic image. In contrast to the application referred to hereinabove in the prior art section, the concentrate is of a sludge-like consistency and has a viscosity of at least 5,000 cps up to about 5 million cps. At present, optimal results have been achieved using a highly concentrated mixture having a viscosity of about 4 million cps.

Pump 4, preferably a pile driver type pump such as Lincoln displacement pump Model 1725, is primed via air cylinder 6 and pumps concentrate from tank 2 through manually controlled valve 8 and into fluid flow line 10 that is connected to process tank 12.

The process tank 12 and associated mechanisms are adapted to hold a liquid toner mixture having the desired solids content range (i.e., the "working solution") and to subsequently feed same to the printing unit of a high speed electrophotographic press. Preferably, a solids content range within the range of 1 to 6% solids is preferred for the working solution, with a range of 2 to 4% being more preferred. At present, it is especially preferred to utilize a liquid toner concentration in tank 12 of about 2% solids based upon the total weight of liquid toner material disposed therein. Concentrate flowing through line 10 is passed through static mixer 14 to be thoroughly mixed prior to discharge into the tank 12. The tank 12 is provided with a conductivity sensor 16 and a density sensor 18, both of which are supplied with recirculated working solution from tank 12 through recirculator line 38.

The conductivity sensor may, for example, comprise a pair of plate electrodes and an indicator to measure current between the electrodes. The density or concentration sensor may, in accordance with conventional techniques, measure resistivity, inductance and/or optical tansmissivity related to predetermined norms in order to assess the solids concentration within the process tank. At present, we prefer to use an in-line conductivity sensor of the type wherein two conductors are separated by a dielectric material. The toner flows between the two conductors and a phase sensitive detection means is used to measure the resistivity of the working solution. For concentration measurement, we use in-line sensors with an incandescent light source and a photodetector to measure optical transmissivity.

Liquid level switches 170, 20, 172, 22, are provided in process tank 12. When liquid level in tank 12 falls below switch 170, all drive units for the concentrate, carrier liquid, and charge control agent are deactivated. An alarm on the operator interface terminal is displayed when a level condition other than normal occurs.

When the liquid level in tank 12 is between the switch 170 and the lower set point switch 20, a signal is actuated to cause carrier liquid to flow to the tank 12 until the upper set point switch 172 is actuated. When the liquid level is between the lower set point switch 20 and the upper set point switch 172, the process tank is monitored for density and conductivity control.

When the maximum level switch 22 is actuated, all supply systems, i.e., concentrate, charge control agent, and carrier liquid flowing to tank 12, are shut off.

Cooling coil 24 is provided in the tank so as to cool the liquid toner material disposed in tank 12 which may tend to become overheated via heat emanating from the pumps and similar devices. It is desired to cool the working solution in tank 12 to about 27–28° C. A thermocouple 25 is provided to monitor the temperature of the liquid toner mixture in the tank 12.

A strainer 26 is provided in the tank 12 so that the working solution is filtered as it passes through check valve 28 through line 30 and into pump 32. Flow through recirculator line 31 into static mixer 14 at inlet 36 is controlled by means of a flow regulator 34. In accordance with the invention, the concentrate flowing through line 10 and the recycled working solution from the recirculator line 31 are mixed in static mixer 14 and, preferably provide, in situ, about a 7% solids mixture that exists at the right-hand side of static mixer 14. The important point here is to provide a material of sufficiently low viscosity that it will readily combine with the bulk of the working solution.

Another recycle line 38 is provided in conjunction with filter means 40 and diverts a portion of the recirculated working solution from tank 12 through the conductivity sensor 16 and the density sensor 18 so that those respective characteristics of the working solution in tank 12 can be monitored. A pressure gauge 42 is provided on the liquid toner flow line 44. The filter means 40 aids in improving print quality maintenance and protects (and hence increases the life of) the photoconductor.

The working solution is drawn from tank 12 by pump 32 and passes through filter 40 into line 44. The flow rate of same is regulated by motorized flow valve 46. The amount of toner called for by valve 46 is correlated to the speed of drum 54 as it is driven during the printing process. The liquid toner then passes through the flow meter 48 and into supply manifold 50 that supplies fresh working solution to the printing station 52 of the electrostatic printing unit. As shown, electrostatic printing unit includes an electrostatic drum 54 on which the latent electrostatic image is formed and a cleaning station 56 adjacent the top side thereof.

Some of the working solution passes through check valve 58 and into fluid line 60 to enter the cleaning station 56. Likewise, carrier liquid emanating from tank 72 can be drawn via pump 66 to pass through check valve 74, filter 68, and check valve 62 into the cleaning station 56. Preferably, the pure carrier liquid from tank 72 is only drawn to cleaning station 56 when the print engine is not running. Flow of carrier liquid from unit 64 and working solution from line 44 to the cleaning station 56 are regulated by control valve 65. Another portion of carrier liquid emanating from tank 72 may be caused to flow via pump 70 through line 71 into the process tank 12.

A drain line 76 is provided to provide for return flow of liquid from cleaning station 56 and manifold 50 through strainer 78 into process tank 12.

A supply of liquid charge control agent is contained within tank 79 and may be caused to flow through line 80 and check valve 81 into the process tank 12 by the action of pump 82.

It is to be understood that, as presently contemplated, both upper and lower electrostatic drums will be provided. Both an upper and lower liquid toner supply, carrier liquid supply and cleaning station supply system will be used. For purposes of brevity and clarity herein, only one such liquid toner supply, carrier liquid supply and cleaning station supply system has been illustrated. The designations "L" and "U" in the drawings denote "lower" and "upper" print units respectively. It is to be understood that the toner supply system and method of the invention could also supply multiple print stations; for example, a four-color process wherein a separate print station is provided for each desired color.

Figure 2:
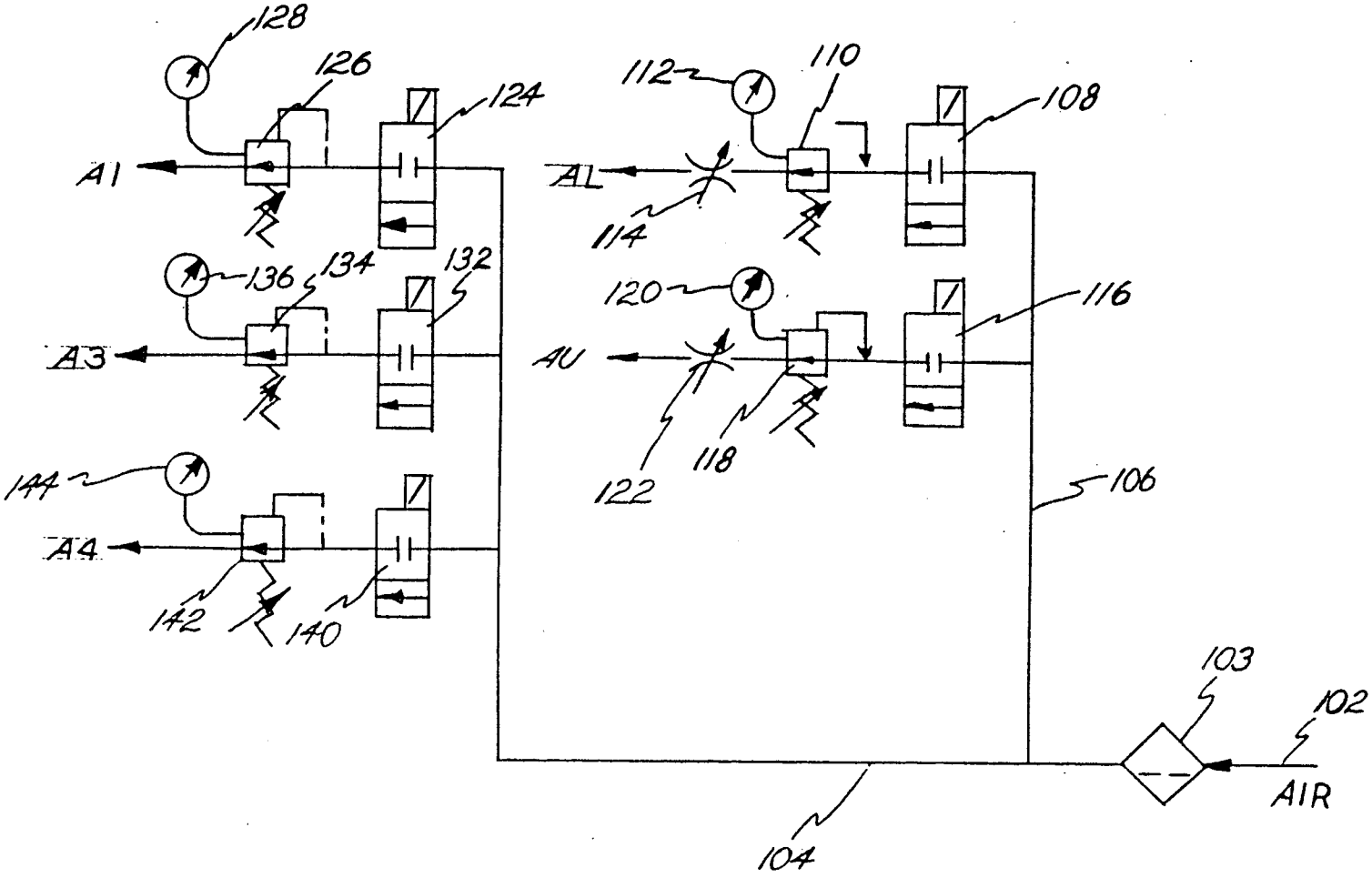
FIG. 2 is a schematic diagram showing the pneumatic flow for controlling several of the control pumps showing in FIG. 1.

Turning now to FIG. 2, a schematic diagram showing the pneumatic air system required to control various parts of the fluid control system shown in FIG. 1, is shown. A source of compressed air 102 and dryer 103 are interconnected. Air passing through dryer 103 is diverted through both lines 104 and 106. Air flowing through line 106 is diverted to flow to either two-envelope solenoid controlled valve 116 or two-envelope solenoid control valve 108. Both the valves 116, 108 are normally closed and are associated with pressure regulators 118, 110 respectively having gauges 120, 112. Adjustable flow control valve 122 regulates the flow of the air for control of pneumatic line AU with similar control afforded pneumatic line AL via adjustable flow control valve 114.

Air flowing through line 104 will similarly encounter the three two-envelope solenoid actuated normally closed valves denoted 124, 132, and 140 where it will then flow through associated pressure regulators 126, 134, 142 and pressure gauges 128, 136, and 144 respectively to provide air for pneumatic control lines Al, A3, and A4.

Accordingly, a regulated pressure of pneumatic air is provided through flow lines AL and AU which are utilized to regulate the pump means 66 shown in FIG. 1 to control the flow of carrier liquid going to the upper and lower cleaning stations 56. The designation AU denotes control of the pump 66 for the upper print unit with AL showing pressure control of the pump 66 designed for the lower unit.

Similarly, a motorized flow control valve 46 can be provided with each unit (see FIG. 1, MV-U and MV-L); both upper and lower flow meters being used to regulate flow of the proper concentrate liquid toner material into the upper and lower printing station of the electrophotographic printing press.

Control line A1 controls air utilized to regulate pump 70 that in turn pumps fresh carrier liquid from tank 72 into process tank 12 responsive to the detection of the condition whereby liquid level in the tank 12 falls between sensor 170 and sensor 20. Liquid level falling between sensor 170 and sensor 20 activates solenoid 124 to provide pneumatic air for the pump 70.

Air line A3 is utilized to drive pump 4 that controls the flow of concentrate material into tank 12. A3 is either "on or off" depending upon the control thereof that is actuated by density sensor 18. Preferably, the density sensor 18 will control actuation (opening of) solenoid valve 132 when it senses that the density of the working solution in tank 12 is below about 1.9.

Fluid flow through line A-4 is utilized to drive the air cylinder 6 needed to prime pump 4. The solenoid valve 140 that opens the air line is actuated by means of a signal from a run relay from the press.

The conductivity sensor 16 is connected to a logic circuit that controls actuation of electric pump 82 to pump liquid charge control agent from tank 79 into process tank 12 when the conductivity of the working solution in tank 12 falls below about 45 picamhos.

In operation, the conductivity sensor 16 senses the conductivity of liquid toner material in tank 12. If the conductivity falls below a predetermined level, then pump 82 is actuated to draw a sufficient amount of charge control agent from tank 79 into process tank 12 until the desired conductivity range is reached.

Density sensor 18 actuates and controls solenoid valve 132 that in turn causes pneumatic air through line A3 to drive pump 4 so as to provide concentrated liquid toner material to the tank 12.

The amount of working solution flowing through line 44 to the printing station 52 is determined by microprocessor control of motorized flow valve 46, which is set to correlate with the speed of electrostatic drum 54 based on the closed loop feed-back from flow meter 48.

In accordance with the above, the electrostatic printing unit is constantly supplied with enough working solution in order to perform the desired printing. This is especially important in light of the high speed nature of the printing unit and the attendant rapid depletion of the working solution and especially the solids content thereof.

Figure 3:
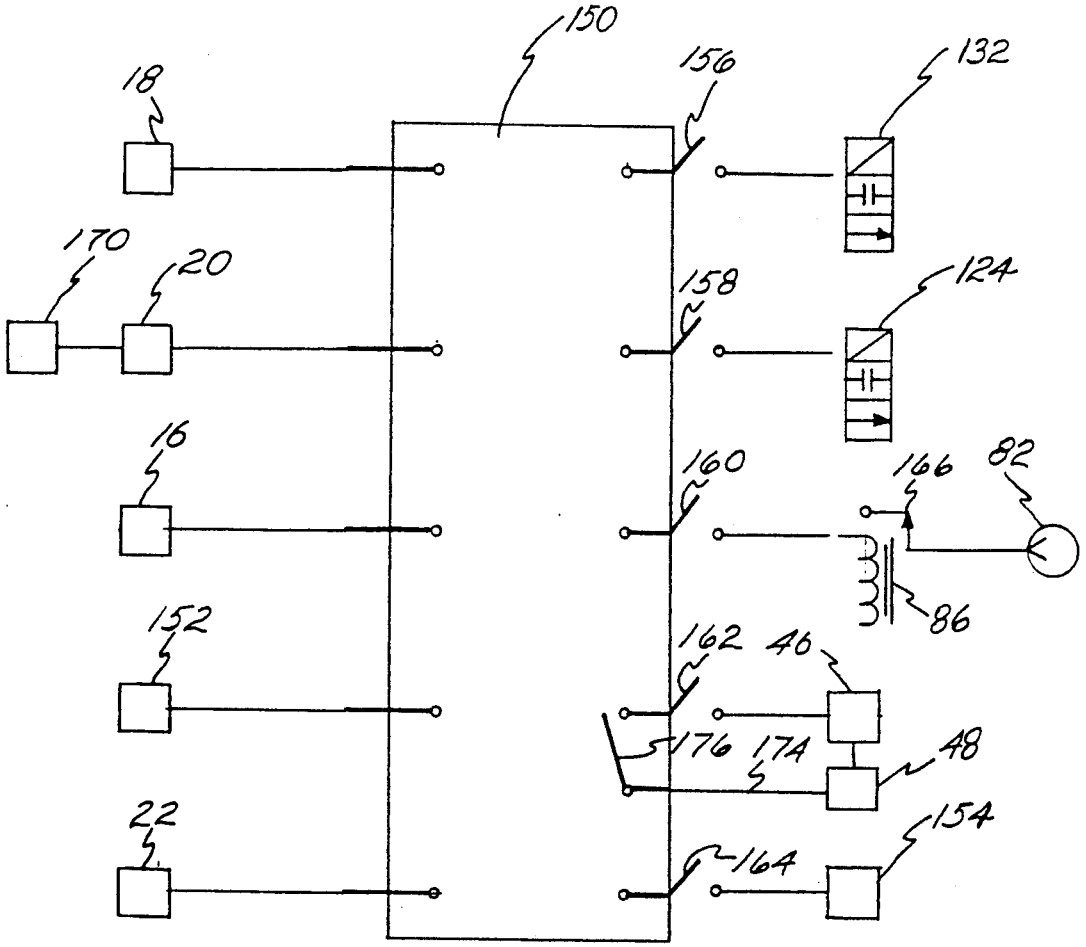
FIG. 3 is a schematic diagram showing the control system for the toner supply system.

Turning to FIG. 3, a basic schematic of the microprocessor control system is shown. Microprocessor 150, preferably TI 565 model available from Texas Instrument provides requisite logic control coordination. The density sensor 18, when sensing a density below a predetermined valve, sends a pulse to microprocessor 150 which actuates switch 156 to forward the electrical pulse to solenoid valve 132. Solenoid valve 132 (FIG. 2) then opens pneumatic air line A3 to actuate Lincoln pump 4. Similarly, conductivity sensor 16, when sensing a conductivity below a predetermined value, sends a pulse to microprocessor 150 that flips switch 160 that, in turn, through relay 86, actuates switch 166 to turn on pump 82.

A pulse is sent through microprocessor switch 158 to actuate solenoid 124 to open pneumatic control line Al to drive pump 70 when switches 170 and 20 indicate liquid level above the minimum level but below the set point.

An encoder 152 is provided to translate linear speed of drum 54 to the predetermined flow rate for flow of working solution through line 44 to the upper and lower printing stations. Switch 162 is closed to send the signal to motorized flow valve 46 in proper direction to draw the correct amount of proper concentrate liquid toner from tank 12 to the supply manifold 50, independent of the pressure drop across the filter. The amount of working solution flow through line 44 is indicated by flow meter 48 with a feedback control line 174 conveying this information to microprocessor 150. If the correct fluid flow is not attained, switch 176 is closed to, in turn, signal and regulate the valve 46 opening so as to obtain proper flow through line 44.

Actuation of maximum liquid level switch 22 sends a pulse to microprocessor 150 and switch 164 to disengage clutch 154 to print drum 54 and to close down pneumatic lines Al, A3, A4, AL, and AU and to open relay 86 so that all materials input to tank 12 are shutdown.

Although this invention has been described with respect to certain preferred embodiments, it will be appreciated that a wide variety of equivalents may be substituted for those specific elements shown and described herein, all without departing from the spirit and scope of the invention as defined in the appended claims.

We claim:

1. Method of supplying a liquid toner dispersion having a solids content within a desired range to the printing station of a high speed electrostatic printing press operating at speeds of 100 ft/min and greater, comprising providing a first, second, and third tank;

filling the first tank with a supply of concentrated liquid toner material, the concentrated liquid toner material having a sludge-like consistency and solids content that is higher than the desired range, said concentrated liquid toner having a viscosity of about 5,000 cps and greater;

filling the second tank with a material adapted to form the carrier liquid of the liquid toner mixture;

causing a sufficient amount of the concentrated liquid toner material and a sufficient amount of the carrier liquid material to flow into the third tank in order to form a working solution defining a liquid toner dispersion having a solids content within the desired range; and conveying working solution from the third tank to the printing station, measuring the speed of said printing press and correlating the speed with a predetermined flow rate of working solution to be conveyed from the third tank to the printing station, monitoring the flow rate of working solution actually conveyed from the third tank to the printing station, and, as a result of the monitoring, regulating the flow of the working solution fed to the printing station to obtain the predetermined flow rate.

2. Method as recited in claim 1 further comprising sensing the density of the working solution and conveying a sufficient amount of concentrated liquid toner from the first tank into the third tank to maintain the solids content of the working solution in the third tank within the desired range.

3. Method as recited in claim 2 further comprising:

providing a fourth tank for containing a liquid charge control agent therein, sensing the conductivity of the working solution in the third tank, and responsive to the conductivity sensing, conveying a sufficient amount of charge control agent from the fourth tank to the third tank to maintain the conductivity of the working solution within a desired range.

4. Method as recited in claim 2 further comprising sensing a liquid level in the third tank and, responsive to said liquid level sensing, conveying a sufficient amount of carrier liquid from the second tank into the third tank until a predetermined liquid level is attained.

5. Method as recited in claim 2 further comprising sensing a predetermined maximum liquid level in the third tank and responsive to said sensing of the maximum liquid level preventing said concentrated liquid toner and said carrier liquid material from flowing into said third tank.

6. Method as recited in claim 2 further comprising mixing the concentrated liquid toner and the working solution.

7. Method as recited in claim 6 wherein the mixing occurs within a mixer connected to the third tank, a portion of the working solution being caused to flow into the mixer, a liquid toner having a solids content intermediate the solids content of the concentrated liquid toner material and the working solution being formed in the mixer and thereafter flowing into the third tank.

8. Method as recited in claim 1 further comprising causing the carrier liquid and the working solution to flow to a cleaning station adjacent said printing press.

9. Method as recited in claim 8 further comprising filtering used working solution from the printing station and the cleaning station and recycling it to the third tank.

10. Method as recited in claim 1 wherein the desired solids concentration range of the working solution is from about 1–6% solids based on the total weight of the working solution.

11. Method as recited in claim 10 wherein the desired solids concentration is from about 2–4% solids.

12. Method as recited in claim 2 wherein the sensing comprises setting a predetermined density level range of about 1.9% and conveying the concentrated liquid toner from the first tank into the third tank when the density falls below the density level range.

13. Method as recited in claim 3 comprising conveying the charge control agent from the fourth tank to the third tank when the conductivity of the working solution in the third tank falls below about 45 pica mhos.

14. Apparatus for supplying a working solution defined by a liquid toner material having a solids concentration within a desired range, to the printing station of a high speed electrostatic printing press operating at speeds of 100 ft/min and greater, comprising (a) first ink means for holding a concentrated liquid toner material having a solids content that is higher than the desired range, said concentrated liquid toner having a viscosity of about 5,000 cps and higher;

(b) second tank means for holding a material adapted to form the carrier liquid of the liquid toner material;

(c) third tank means adapted to hold the working solution, the third tank means being in fluid connection with the first and second tank means; and (d) means for conveying the working solution from the third tank means to the printing station in a flow rate amount that is correlated to the speed of the printing press, means (d) including means for measuring the speed of the printing press, means for correlating the speed with a predetermined flow rate of working solution to be conveyed from the third tank means to the printing station, means for monitoring the flow rate of a working solution actually conveyed from the third tank means to the printing station, and, responsive to the monitoring flow regulating means for regulating the flow of working solution fed to the printing station.

15. Apparatus as recited in claim 14 further comprising (e) sensing means for sensing the density of the working solution in the third tank means; and (f) means responsive to the sensing means (e) for conveying a sufficient amount of concentrated toner material from the first tank means into the third tank means to maintain the density of the working solution in the third tank means within a desired range.

16. Apparatus as recited in claim 14 further comprising a fourth tank means (g) for holding a supply of liquid charge control agent therein connected to the third tank means (c), conductivity sensor means (h) for measuring the electrical conductivity of the working solution in the third tank means, and means (i) responsive to the conductivity sensor means (h) for conveying a sufficient amount of the charge control agent from the fourth tank means (g) into the third tank means (c) to maintain the conductivity of the working solution in the third container means within a desired range.

17. Apparatus as recited in claim 14 further comprising liquid level sensing means (j) disposed in the third tank means (c) for detecting liquid level therein, means (k) responsive to the liquid level sensing means (g) for conveying a sufficient amount of the carrier liquid from the second tank means (b) to the third tank means (c) upon sensing of a lower liquid level limit detected by the liquid level sensing means (j).

18. Apparatus as recited in claim 17 further comprises means (1) responsive to the liquid level sensing means (j) for preventing flow of said carrier liquid from the second tank means (b) to the third container means (c), for preventing flow of said charge control agent into the third tank means and preventing flow of said concentrated toner material into the third tank.

19. Apparatus as recited in claim 14 further comprising mixing means (m) for mixing liquid toner material from the first tank means (a) and the third tank means (c).

20. Apparatus as recited in claim 19 wherein said mixing means (m) comprises a static mixer and wherein recirculator means (n) are connected to the third tank means (c) for circulating a portion of the working solution from the third tank means (c) to the static mixer.

21. Apparatus as recited in claim 14 further comprising a cleaning station adjacent the electrostatic printing press, and means (p) for conveying material from the third tank means (c) and liquid carrier from the second tank means (b) to the cleaning station.

22. Apparatus for supplying a working solution defined by a liquid toner material having a solids concentration within a desired range, to the printing station of an electrostatic printing press comprising (a) first tank means for holding a concentrated liquid toner material having a solids content that is higher than the desired range, said concentrated liquid toner having a viscosity of about 5,000 cps and higher;

(b) second tank means for holding a material adapted to form the carrier liquid of the liquid toner material;

(c) third tank means adapted to hold the working solution, the third tank means being in fluid connection with the first and second tank means;

(d) means for conveying the working solution from the third tank means to the printing station in a flow rate amount that is correlated to the speed of the printing press, a clean up station adjacent the electrostatic printing press, and means for conveying material from the third tank means (c) and liquid carrier from the second container tank means (b) to the cleaning station.

* * * * *